US007475926B2

(12) United States Patent
Summars

(10) Patent No.: US 7,475,926 B2
(45) Date of Patent: Jan. 13, 2009

(54) SYNTHETIC ROUNDSLING WITH INSPECTABLE CORE

(75) Inventor: Linda R. Summars, Mustang, OK (US)

(73) Assignee: First Sling Technology LLC, Mustang, OK (US)

( * ) Notice: Subject to any disclaimer, the term of this patent is extended or adjusted under 35 U.S.C. 154(b) by 83 days.

(21) Appl. No.: 11/160,303

(22) Filed: Jun. 17, 2005

(65) Prior Publication Data

US 2006/0208513 A1 Sep. 21, 2006

Related U.S. Application Data

(60) Provisional application No. 60/581,131, filed on Jun. 19, 2004.

(51) Int. Cl.
*B66C 1/12* (2006.01)

(52) U.S. Cl. ..... 294/74

(58) Field of Classification Search ..... 294/74–77, 294/86.42, 68.42
See application file for complete search history.

(56) References Cited

U.S. PATENT DOCUMENTS

| | | | | | |
|---|---|---|---|---|---|
| 3,310,333 | A | * | 3/1967 | Hutson | 294/82.11 |
| 3,436,114 | A | * | 4/1969 | Lange et al. | 294/74 |
| 3,463,534 | A | | 8/1969 | Norton | |
| 3,718,945 | A | * | 3/1973 | Brindejonc de Teglode | 24/370 |
| 3,839,637 | A | * | 10/1974 | Willis | 250/302 |
| 3,899,206 | A | * | 8/1975 | Miura | 294/74 |
| 4,025,100 | A | | 5/1977 | Bridgehouse | |
| 4,350,380 | A | * | 9/1982 | Williams | 294/74 |
| 4,354,704 | A | * | 10/1982 | Mayerjak | 294/74 |
| 4,513,692 | A | * | 4/1985 | Kuhnsman et al. | 119/795 |
| 4,757,719 | A | | 7/1988 | Franke | |
| 4,789,045 | A | | 12/1988 | Pugh | |
| 4,843,807 | A | | 7/1989 | Von Danwitz et al. | |
| 4,850,629 | A | | 7/1989 | St. Germain | |
| 5,015,859 | A | | 5/1991 | Uejio | |
| 5,071,118 | A | | 12/1991 | Barnett | |
| 5,238,279 | A | | 8/1993 | Anteau | |
| 5,651,572 | A | * | 7/1997 | St. Germain | 294/74 |
| 5,727,833 | A | | 3/1998 | Coe | |
| 5,890,564 | A | | 4/1999 | Olsen et al. | |
| 6,073,728 | A | | 6/2000 | Olsen et al. | |
| 6,080,982 | A | | 6/2000 | Cohen | |

(Continued)

FOREIGN PATENT DOCUMENTS

| | | |
|---|---|---|
| CA | 2202933 | 10/1998 |

(Continued)

OTHER PUBLICATIONS

English Translation of "Fiber Sling" Pub. No. JP 2000-136086A, Published May 16, 2000, Appl. No. 10309273, Applicant: Unitika Ltd. et al., Inventor: Kajiwara Koji.

(Continued)

*Primary Examiner*—Dean J Kramer
(74) *Attorney, Agent, or Firm*—Mary M. Lee

(57) ABSTRACT

A roundsling with a fully inspectable core. The roundsling comprises synthetic, non-metallic core yarns contained in a tubular cover that is transparent. Because the cover is transparent, the load-bearing core fibers are entirely, frequently and directly visible before, during and after use.

4 Claims, 1 Drawing Sheet

U.S. PATENT DOCUMENTS

| | | | | |
|---|---|---|---|---|
| 6,247,359 | B1 | 6/2001 | DeAngelis | |
| 6,422,624 | B1 * | 7/2002 | Kauffman et al. | 294/74 |
| 7,240,475 | B2 | 7/2007 | Smeets et al. | |
| 2006/0261617 | A1 | 11/2006 | St. Germain | |

FOREIGN PATENT DOCUMENTS

| | | | | |
|---|---|---|---|---|
| CA | 2547632 | A1 | | 11/2006 |
| EP | 0 785 163 | A2 | | 7/1997 |
| EP | 0 785 163 | A3 | | 12/1997 |
| FR | 2272946 | A | * | 1/1976 |
| JP | 10168773 | | | 6/1998 |
| JP | 2001279587 | | | 10/2001 |
| JP | 2000-136084 | A | | 5/2005 |
| WO | WO2006127489 | A1 | | 11/2006 |

OTHER PUBLICATIONS

Patent Abstract of Japan, "Fiber Sling" Pub. No. 2000 136086, Published May 16, 2000, Appl. No. 10309273, Applicant: Unitika Ltd., Inventor: Kajiwara Koji.

QC21 Sling Manufacturing, "QC21—The Clear Choice," website at http://www.qc21slings.com/assets/pdf/qc21_synwebslings.pdf, published prior to the filing of the above-referenced patent application.

Abstract of patent JP2001279587.

Abstract of patent JP10168773.

Thomas G. Dolan, "The Inspectable Round Sling: A technological breakthrough by First Sling Technology," Wire Rope News and Sling Technology, (Dec. 2007), pp. 8, 10, 14, 16, 18, vol. 29, No. 2, Wire Rope News LLC, Colonia, NJ, USA.

* cited by examiner

SYNTHETIC ROUNDSLING WITH INSPECTABLE CORE

CROSS-REFERENCE TO RELATED APPLICATIONS

This application claims the benefit of provisional application Ser. No. 60/581,131, filed Jun. 19, 2004, entitled "Roundsling with Inspectable Core," the contents of which are incorporated herein by reference.

FIELD OF THE INVENTION

The present invention generally relates to synthetic roundslings.

BACKGROUND OF THE INVENTION

Industrial slings are an important tool in lifting and moving heavy loads. Lifting slings are fabricated of alloy steel chain, wire rope, metal mesh, synthetic fiber rope, synthetic webbing, and synthetic fiber yams enclosed in a protective cover. Slings are also available in a variety of configurations, including single and multi-leg bridle slings, eye-and-eye slings, and endless loop slings. The type of sling used for a particular job depends on several factors, including the weight and nature of the load, and the temperature and chemical content of the environment.

Steel slings are resistant to high temperatures and inert to many chemicals, but they are heavy and stiff and likely to damage the exterior surface of the loads. While synthetic slings have temperature and weight-bearing limits below those of comparable steel slings, they offer a highly flexible and lightweight alternative in appropriate applications. The flexible fibers closely grip the contours of a load and are less likely to damage the load's exterior. The synthetic material can be color coded to reduce the likelihood of improper use, and it is not susceptible to corrosion. Synthetic slings do not require grease and, consequently, no gloves are needed to handle them.

A synthetic roundsling has an endless core formed of a number of loops of synthetic yarn contained in a synthetic sleeve or cover. The inner core yarn provides the strength to lift the load, and the cover protects the core and comes into contact with the load. The weight bearing points in a roundsling vary with each use, as compared to a rope sling, for example, on which the lift the points are fixed at the eyes of the sling.

These core fibers, however, are susceptible to damage from abrasion or sharp edges and to degradation from exposure to heat, caustic chemicals, or other environmental pollutants. The core yarn may be damaged when the sling is not rotated between uses so that the same wear points are permitted to stay in contact with the device used for lifting, such as hooks on a crane. In addition, malfunction may occur as a result of manufacturing defects, defective core yarns, or friction between the hidden core yarns that cannot be inspected in existing slings. For these reasons, frequent and adequate inspection of roundslings is important to detect perceptible damage and defects.

On most types of slings, such as chain slings for example, the load bearing elements are continuously open to inspection before, during and after use. However, inspection of a synthetic roundsling is problematic. The protective cover prevents direct inspection of the load-bearing fibers inside.

Criteria have been developed for determining when a synthetic roundsling should be removed from service. For example, if acid or caustic burns or heat damage is seen on the cover, or the cover exhibits tears or snags, the sling should be removed from service. Presently, all inspection criteria of synthetic roundslings relate to the condition of the cover or to the core yarns visible through an opening in the cover. In other words, direct inspection of the core fibers is not possible until the cover has already suffered damage.

Several useful techniques and devices have been developed for indicating the likely condition of the hidden core yarns. For example, some synthetic roundslings are equipped with fiber optic filaments with "tell tails" extending through the cover. The tell tails indicate that the sling has experienced over stretching or that other abuse has occurred that may have damaged the core. Though these advances are useful, there remains a need for a synthetic roundsling in which the core yarns can be inspected directly, frequently and entirely.

SUMMARY OF THE INVENTION

The present invention comprises a synthetic roundsling. The roundsling comprising an endless load-bearing core formed of a plurality of loops of synthetic, non-metallic material. The core is contained within an endless tubular cover formed of transparent material through which the condition of substantially the entire core is viewable.

DETAILED DESCRIPTION OF THE PREFERRED EMBODIMENTS

Figure 1:
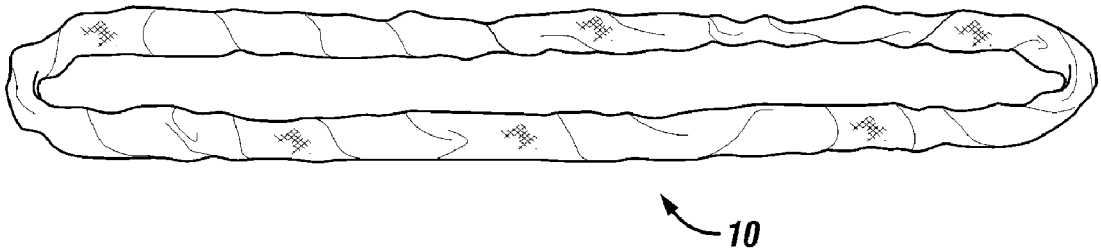
FIG. 1 is a plan view of a roundsling made in accordance with the present invention.
Figure 2:
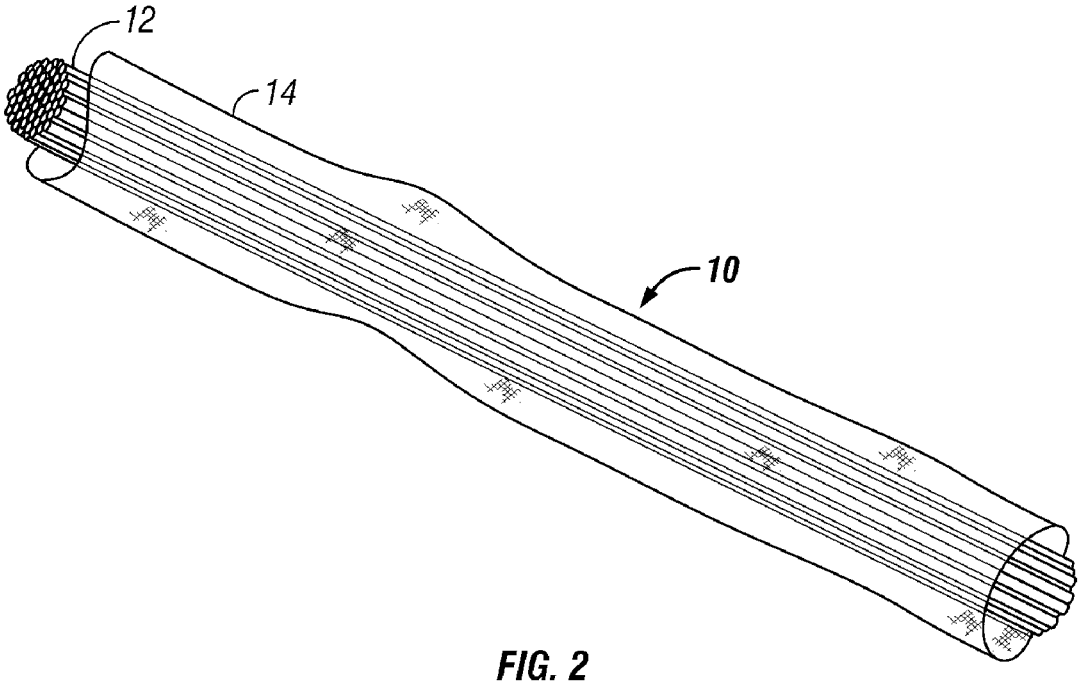
FIG. 2 is an enlarged fragmented view of the roundsling of FIG. 1.

Turning now to the drawings in general and to FIG. 1 in particular, there is shown therein a roundsling made in accordance with the present invention and designated generally by the reference numeral 10. As shown in FIG. 2, the roundsling 10 comprises a load-bearing core 12 contained within a tubular cover 14.

The load-bearing core 12 is formed of synthetic fibers. Preferably, the core 12 comprises a plurality of endless loops of synthetic, non-metallic material. By way of example, the fibers may be formed of nylons, polyesters, polyethylenes or polypropylenes, or a combination of any of these. For example, the fibers may be formed of a high density polyethylene polymer sold by Honeywell International, Inc. under the SPECTRA. Alternately, the load lifting core yarn may comprise synthetic poly(ethylene terephthalate) fiber sold by the DuPont Company under the brand name DACRON®, or a synthetic aramid polymer material, such as poly(p-phenylene terephthalamide) sold by the DuPont Company under the brand name KEVLAR®, a para-linked aramid material, such as TECHNORA sold by Teijin Kabushiki Kaisha of Japan. Still further, the core fibers may comprise a combination of any of these.

The tubular cover 14 that contains the core yarns 12 is selected for its general ability to protect the yarns inside and to provide an abrasion resistant surface for the sling. The technique for making the cover 14 will depend on the material from which it is made. It may be woven or extruded in a seamless tube. Alternately, the cover 14 may be formed by adjoining the long edges of an elongate strip of material by some suitable means, such as stitching, seaming, stapling, gluing, hot melt adhesive and the like.

The material for forming the cover 14 preferably is a transparent material through which the condition of substantially the entire core is viewable. As used herein, "transparent" means any condition which permits the core fibers to be visually inspected therethrough. Thus, "transparent," as applied to the cover 14, includes a fabric formed of threads or fibers that are clear or transparent so that, no matter how tightly woven or integrated, the core yarns 12 are visible through it, as is depicted in FIG. 2.

In addition, "transparent" encompasses an otherwise opaque material or fabric that is so porous or loosely woven that the condition of the core fibers can be seen through the voids in the weave. Still further, "transparent" includes a condition that permits fluorescent material, when exposed to ultraviolet light, to be seen through the cover.

One preferred material for the cover 14 is netting of the type used for insect screens, such as that sold as "no-thrips" insect screen by BioQuip Products, Inc. (Rancho Dominguez, Calif.). This netting material is made of high tensile-strength monofilaments. It is UV resistant and stabilized, and lightweight. The mesh size 81×81 has a hole opening size of 0.0059×0.0059, a thread size of 0.15 mm, light transmission of 66%, and a weight of 0.216 lbs./sq. yd.

The diameter and circumference of the roundsling 10 may vary depending on the intended uses. The roundsling 10 may also include a label (not shown) showing the manufacturer, the code or stock number, load capacities, and core and cover materials, as is presently required by ASME standards.

Now it will be appreciated that the roundsling 10 of the present invention offers advantages not heretofore available in synthetic roundslings. The transparent cover 14, in whatever form it takes, allows substantially the entire core 12 to be visually inspected. In the preferred embodiment, where the cover 14 is formed of clear or translucent fabric, the entire length and circumference of the core 12 can be visualized without opening, turning or otherwise manipulating the cover. In addition, the core 12 can be seen at all times—before, during and after each use. In this way, the sling 10 can be removed from service immediately upon exhibiting any change or damage that compromises its safe use.

Changes can be made in the combination and arrangement of the various parts and elements described herein without departing from the spirit and scope of the invention as defined in the following claims.

What is claimed is:

1. A synthetic roundsling comprising:

an endless load-bearing core comprising a plurality of loops of synthetic non-metallic fibers; and an endless tubular cover containing the core loosely so that the fibers in the core are movable relative to each other and to the cover, and wherein the cover is formed of transparent material through which the condition of substantially the entire core is viewable, and wherein the cover is formed of fabric that is woven of transparent filaments.

2. The roundsling of claim 1 wherein the core fibers are fluorescent and the cover is formed of material characterized as transparent to fluorescence upon exposure to ultraviolet light.

3. The roundsling of claim 1 wherein the core fibers are formed of nylon, polyester, polyethylene, or polypropylene, or a combination of any of these.

4. The roundsling of claim 1 wherein the cover is seamless.

* * * * *